US006119399A

United States Patent [19]

McCain et al.

[11] Patent Number: 6,119,399

[45] Date of Patent: Sep. 19, 2000

[54] CHANNEL GUIDED PARALLELOGRAM GATE

[76] Inventors: Roy L. McCain, P.O. Box 247; Allen G. Wasson, P.O. Box 58, both of Randall, Wash. 98377; Rocky E. Mountain, P.O. Box 477, Lakebay, Wash. 98349

[21] Appl. No.: 09/247,658

[22] Filed: Feb. 9, 1999

[51] Int. Cl.[7] ..... E01F 13/06; E05F 15/20; E05D 7/06

[52] U.S. Cl. ..... 49/340; 49/49; 49/25; 49/227

[58] Field of Search ..... 49/339, 340, 324, 49/227, 49, 131, 25

[56] References Cited

U.S. PATENT DOCUMENTS

| | | | |
|---|---|---|---|
| 3,968,596 | 7/1976 | Danin | 49/49 |
| 4,457,105 | 7/1984 | Danin | 49/49 |
| 4,490,068 | 12/1984 | Dickinson | 404/6 |
| 4,495,730 | 1/1985 | Kennedy | 49/280 |
| 4,519,164 | 5/1985 | Porter . | |
| 4,658,543 | 4/1987 | Carr . | |
| 4,681,479 | 7/1987 | Wagner . | |
| 4,767,253 | 8/1988 | Luck | 414/339 |
| 4,818,136 | 4/1989 | Nasatka et al. | 404/6 |
| 4,828,424 | 5/1989 | Crisp | 404/6 |
| 4,850,737 | 7/1989 | Nasatka et al. | 404/6 |
| 4,934,097 | 6/1990 | Quante | 49/49 |
| 5,136,810 | 8/1992 | Dewitt . | |
| 5,263,281 | 11/1993 | Osborn . | |
| 5,299,386 | 4/1994 | Naegelli et al. . | |
| 5,440,838 | 8/1995 | Lesser | 49/340 |
| 5,459,963 | 10/1995 | Alexander . | |

FOREIGN PATENT DOCUMENTS

| | | | |
|---|---|---|---|
| 1961391 | 12/1982 | Germany | 49/49 |

*Primary Examiner*—Daniel P. Stodola
*Assistant Examiner*—Gregory J. Strimbu
*Attorney, Agent, or Firm*—Brian J. Coyne

[57] ABSTRACT

A parallelogram gate for controlling traffic on a roadway, comprised of an arm assembly that is rotatable between a raised position and a horizontal, longitudinally-extended, roadway blocking position, a housing, and a drive assembly mounted within the housing. The arm assembly has parallel, elongated upper and lower rails, and a plurality of spaced-apart pickets pivotally attached to the upper and lower rails. A stationary pivot attaches a pivot end of the upper rail to the housing. A pair of vertical, grooved channel guides are attached to the housing at a location within the housing that is intermediate the stationary pivot and a lower portion of the housing. The drive assembly includes a hydraulic cylinder having a vertically-upward directed piston arm and mounted to the lower portion of the housing. A horizontal pin inserted through a traveling clevis carried by the piston arm, and inserted through a pivot end of the lower rail, extends into a groove within each of the guides. A pair of rollers is mounted for rotation about the pin and for vertical, translational motion within the grooves. The drive assembly includes a hydraulic drive system that raises and lowers the piston arm, and thus the arm assembly, in response to manual and/or radio frequency controls. The channel guides stabilize the gate against wind forces when the arm assembly is in the raised position.

5 Claims, 10 Drawing Sheets

CHANNEL GUIDED PARALLELOGRAM GATE

BACKGROUND OF THE INVENTION

1. Field of the Invention

The present invention relates generally to gates for controlling traffic through a fence or along a roadway, and has particular reference to lift gates and parallelogram lift gates.

2. Background of the Prior Art

Gates having closure members, such as rails, pivotally connected to a vertical pivot post for movement in a horizontal plane require sufficient unobstructed ground area to accommodate the swing radius of the closure members. Lift gates having closure members that pivot through a vertical plane have been widely used instead wherever the ground area devoted to a gate was to be minimized, thereby permitting use in cramped areas. Such lift gates included, for example, the safety gate assembly disclosed by Naegelli et al., U.S. Pat. No. 5,299,386; the security gate disclosed by Osborn, U.S. Pat. No. 5,263,281; the parking gate disclosed by DeWitt III, U.S. Pat. No. 5,136,810; the portable traffic control gate disclosed by Wagner et al., U.S. Pat. No. 4,681,479; and the gate with multiple pivot axes for rail members disclosed by Porter, U.S. Pat. No. 4,519,164.

A type of lift gate known as a parallelogram gate has also been widely used. The closure members of a parallelogram gate comprise parallel upper and lower rails pivotally mounted for movement in a vertical plane, and a plurality of vertical members disposed along the lengths of the rails, the upper and lower ends of the vertical members being pivotally attached to the upper and lower rails, respectively. See, for example, the swinging lift gate disclosed by Carr, U.S. Pat. No. 4,658,543. As the gate is raised towards vertical, the upper and lower rails of a parallelogram gate move closer together, thereby closing the parallelogram and providing maximum clearance for vehicles to pass by the gate. The ability to close the parallelogram also permits compact shipment of the closure members of a parallelogram lift gate.

As the closure members of a lift gate are raised, the gate, and particularly the pivot points of the closure members located on the pivot post of the gate, tends to become maximally stressed by any wind forces impacting the closure members. It appears that prior to the present invention, no provision was made in lift gates for adequately distributing and dissipating such forces at the pivot point(s) so as to stabilize the gate against wind loads. There remains, therefore, a need for a parallelogram lift gate capable of adequately distributing and dissipating wind load forces.

SUMMARY OF THE INVENTION

The present invention provides a parallelogram lift gate for controlling traffic along a roadway. The lift gate includes an arm assembly long enough to span the distance across the roadway, and a drive assembly for placement on a first side of the roadway. The arm assembly is movable in a vertical plane between a horizontal, roadway-blocking position and a raised vertical position. The arm assembly includes an upper rail having a first, pivoted end and a second, opposite free end, and a lower rail having a first, pivoted end and a second, opposite free end. The lower rail is parallel to the upper rail and, when the arm assembly is in the fully lowered position, the lower rail is disposed below the upper rail. The arm assembly may further include a plurality of vertical members or pickets distributed along the lengths of the rails, the upper and lower ends of each picket being pivotally attached to the upper and lower rails, respectively.

The drive assembly includes a housing which, in a preferred embodiment, has a weatherproof casing as well as shelving and vertical panels for supporting the drive assembly components. A stationary upper rail pivot means pivotally attaches the first, pivot end of the upper rail to the housing. Below, and longitudinally displaced from, the upper rail pivot means are a pair of vertically-elongated, spaced-apart channel guides attached to the housing. Each channel guide has an elongated vertical groove, the grooves being oppositely and symmetrically disposed with respect to one another. Movable lower rail pivot means are pivotally attached to the pivot end of the lower rail and disposed between the channel guides for vertical movement within the grooves thereof. The lower rail pivot means moves within the vertical grooves between a first, lower position and a second, upper position, corresponding to the horizontal road-blocking and the raised vertical positions of the arm assembly, respectively. The drive assembly further includes linear actuator means attached to the housing for moving the lower rail pivot means within the vertical grooves.

In a preferred embodiment, the linear actuator means is a hydraulic drive system that includes a hydraulic cylinder having a lower end pivotally attached to the housing and a piston arm pivotally attached to the pivot end of the lower rail. An electric motor mounted to the housing is in driving engagement with a hydraulic pump. The pump is equipped with a hydraulic reservoir and with a control valve for controlling release of hydraulic fluid from the pump. Hydraulic conduit conducts hydraulic fluid from the pump to the cylinder when the arm assembly is ascending and returns the fluid to the pump and reservoir when the arm assembly is descending.

The vertical grooves of the channel guides are preferably C-shaped in horizontal cross-section. The stationary upper rail pivot means includes a first pin inserted through the pivot end of the upper rail and through adjacent panels of the housing. In a preferred embodiment, the cylinder piston arm is equipped with a traveling clevis that has a transverse, horizontal bore, and the lower rail pivot means includes a second, clevis pin inserted through the bore of the traveling clevis and inserted also through a transverse bore in the pivot end of the lower rail. The clevis pin extends into each of the vertical grooves. The lower rail pivot means further includes a pair of wheels or rollers, one each of the rollers being disposed within one of the grooves and mounted for rotation about the clevis pin. The combination of the clevis pin and pair of rollers together with the channel guides serves to facilitate vertical movements of the lower rail pivot means and to distribute and dissipate wind forces transmitted by the arm assembly to the lower rail pivot means.

A hydraulic system control means is also provided. The control means includes manual means for creating a "gate up" and a "gate down" signal. A "gate up" signal energizes the motor, which activates the hydraulic pump, causing the hydraulic cylinder to raise the arm assembly. While the arm assembly is rising, hydraulic fluid from an upper, piston arm end of the cylinder is conducted to an accumulator, where the fluid is stored under pressure. A normally closed upper limit switch, attached to the housing, is wired to an electronic control module. When the arm assembly reaches vertical, the upper limit switch opens, thereby causing the control module to de-energize the solenoid of a solenoid switch wired in series with the motor, which shuts down the motor. In response to a "gate down" signal, hydraulic fluid is permitted to drain back to the pump and the reservoir from the blind end of the cylinder, which permits the arm assembly to descend back to a lowered position; meanwhile, bypass means provides a path for fluid in the accumulator to bypass the cylinder and drain back to the pump and reservoir. The lift gate optionally further includes means for sending "gate up" and "gate down" RF signals, such as might be done by the driver of a vehicle who desires to pass through the gate, and means responsive to the "gate up" and "gate down" RF signals for energizing and deenergizing the motor and for activating the bypass means. Further options include an electric battery wired to the motor, a trickle charger attachable to an alternating current source for maintaining the battery in a charged condition, and a battery charger solar panel wired to the battery.

DETAILED DESCRIPTION OF THE PREFERRED EMBODIMENTS

Figure 1:
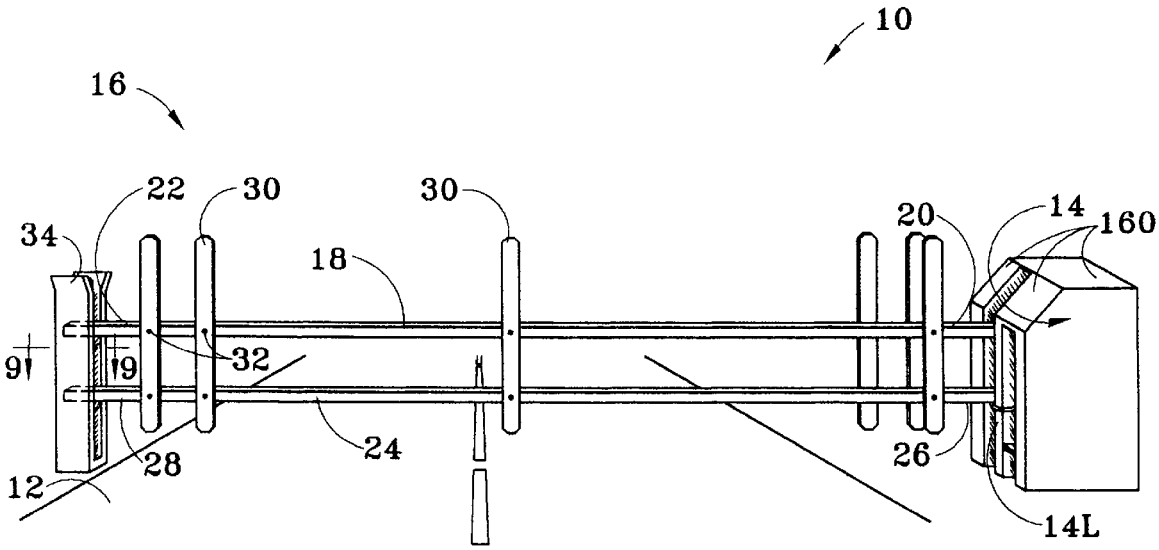
FIG. 1 is a front elevational view of the invention installed on a roadway with the arm assembly in a lowered, road-blocking position.
Figure 2:
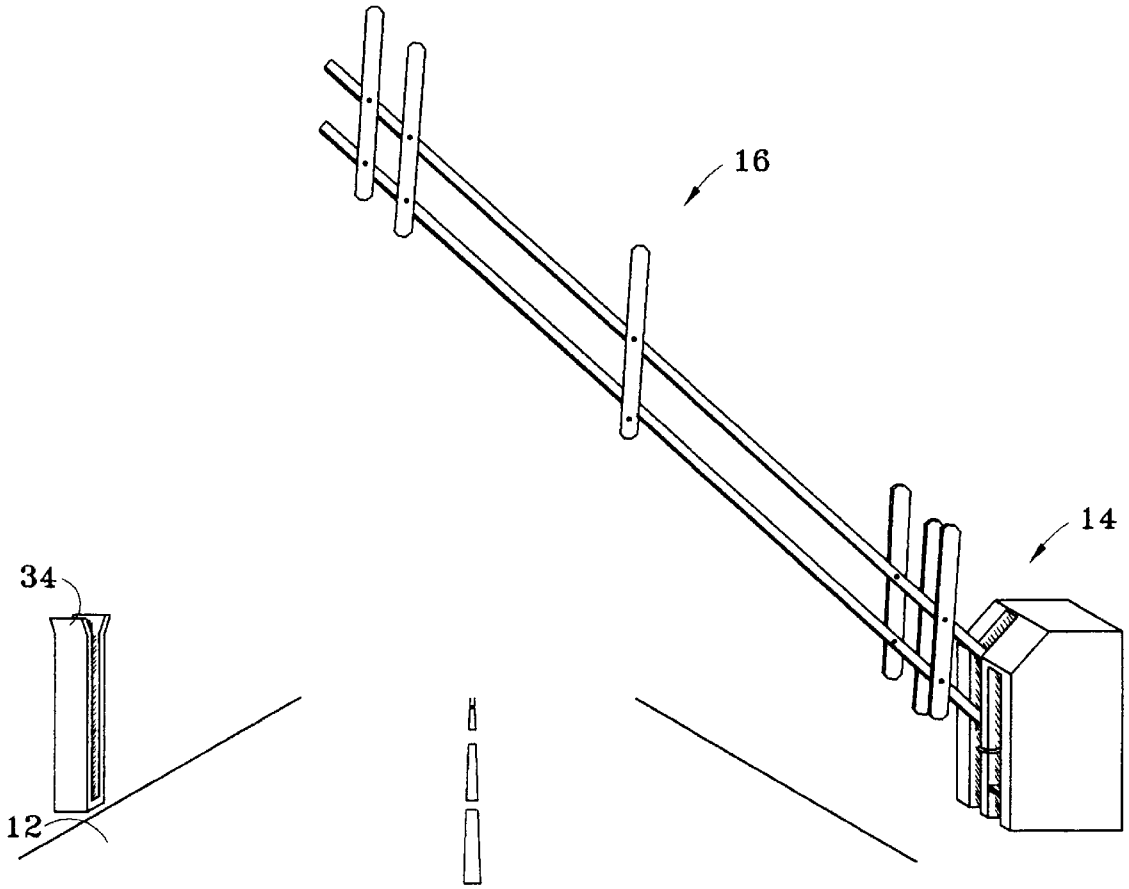
FIG. 2 is a front elevational view of the invention with the arm assembly in a raised position.

FIG. 1 is a frontal perspective view of one preferred embodiment of the invention, denoted generally by the numeral 10, installed across a roadway 12. A lift gate drive assembly 14 is shown resting on the ground on the right side of, and immediately adjacent to, the right side of roadway 12. Pivotally attached to the lift gate drive assembly 14 is an arm assembly 16 of sufficient length to extend fully across the roadway 12 and movable between a lowered, horizontal, road-blocking position, as shown in FIG. 1, and a raised, vertical position, as shown in FIG. 2.

Figure 9:
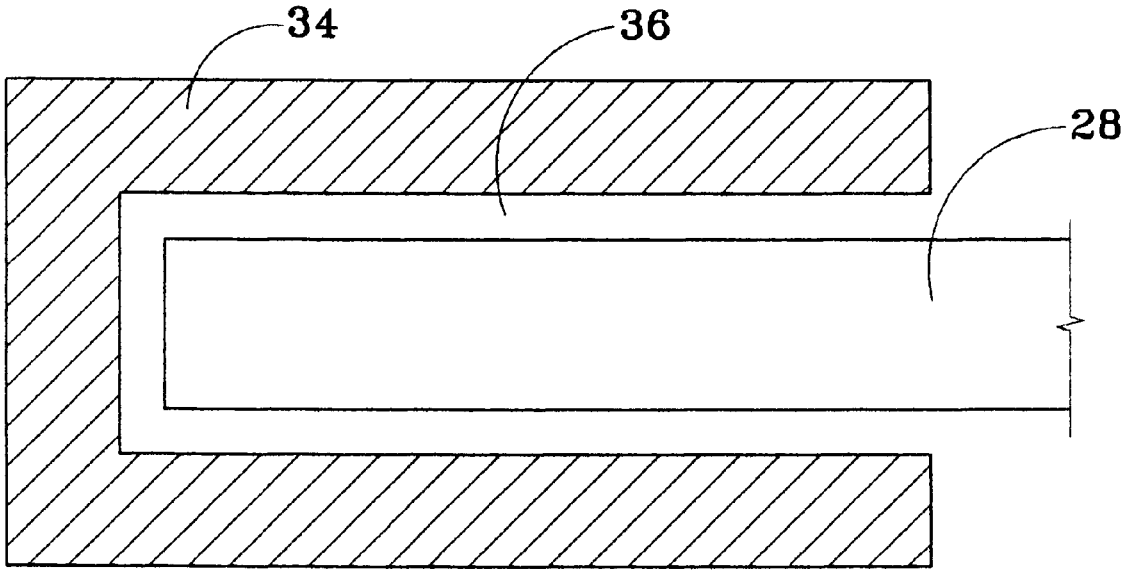
FIG. 9 is a horizontal cross-sectional view of the barrier post taken along line 9—9 of FIG. 1.

The arm assembly 16 includes an upper rail 18 having a first, pivoted end 20 and an opposite free end 22, and a lower rail 24 parallel to the upper rail 18, having a first pivoted end 26 and an opposite free end 28. Each of the rails 18, 24 has a pair of vertical walls 18V, 24V joined by an upper wall 18U, 24U, respectively, as may be seen in FIG. 3. The arm assembly 16 further includes a plurality of pickets 30 distributed along the lengths of the rails 18, 24, each picket 30 being pivotally attached to the upper and lower rails 18, 24, as, for example, by horizontal pins 32. Opposite the drive assembly 14, on the left side of the roadway 12, is a vertical barrier post 34. As shown in FIG. 9, the barrier post 34 is C-shaped in horizontal cross-section, thereby defining a vertically-elongated recess 36 for receiving the free ends 22, 28 of the rails 18, 24 when the arm assembly 16 is in the lowered position depicted in FIG. 1.

Figure 3:
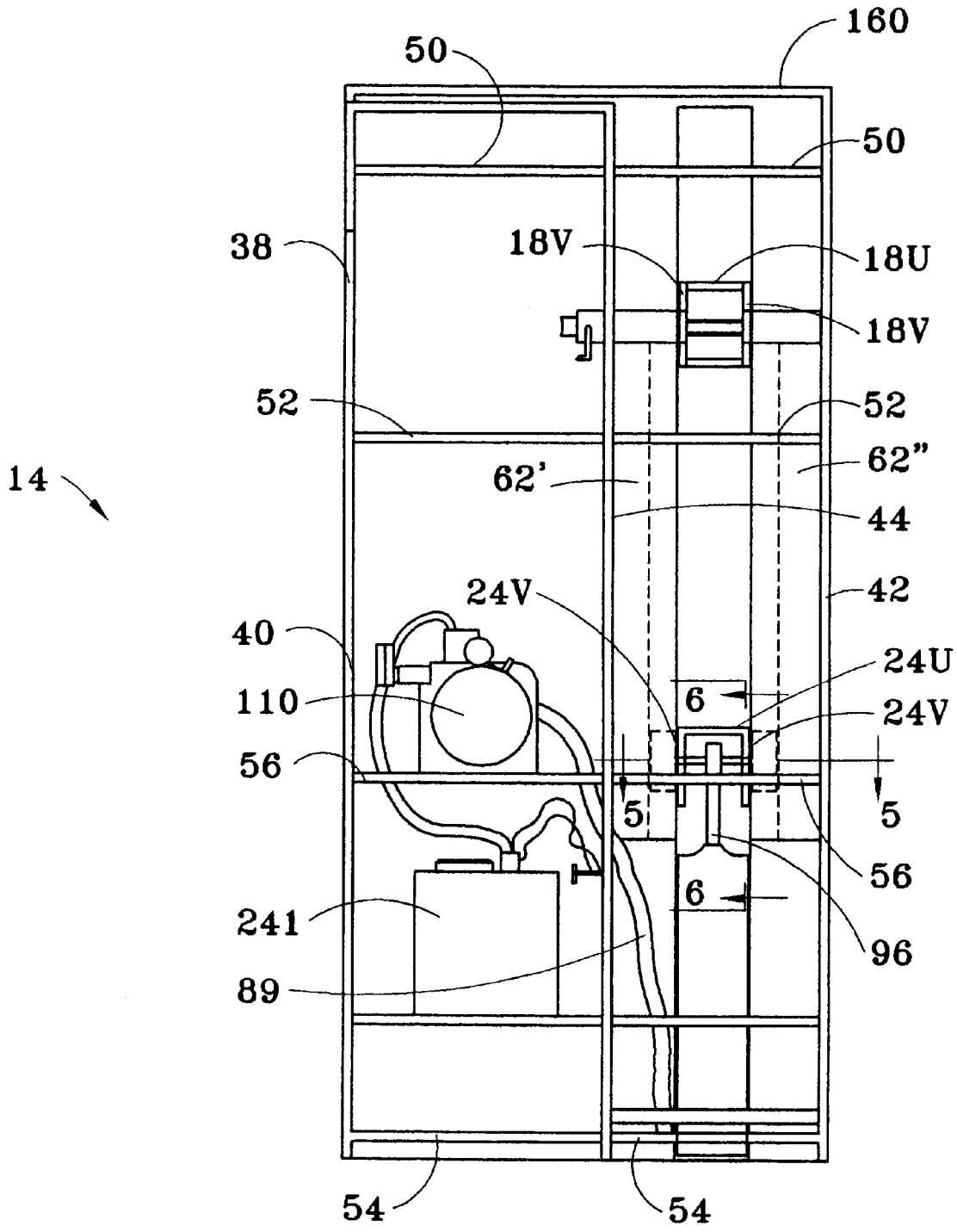
FIG. 3 is a right side elevational view of the drive assembly with the arm assembly in a lowered position.

Referring now to FIGS. 1 and 3, the drive assembly 14 includes a housing 38 having a left wall 40, a right wall 42, and a divider wall 44 intermediate the left and right walls 40, 42; all the walls 40, 42, 44 are vertical and parallel. Interposed between, and connecting, the walls 40 and 42, and the walls 42 and 44, are a plurality of horizontal upper, intermediate, and lower struts 50, 52, and 54, respectively. Horizontal upper shelves 56 are suspended between the front and divider walls 40, 44, and between the divider and the right walls 44, 42; and a lower shelf 58 is suspended between the front wall 40 and the divider wall 44. The housing 38 further includes a removable, vertical right panel (not shown), and roof panels 160 extending over the space defined by the walls 40, 42, 44. To permit pivoting movement of the rails 18, 24, however, no left wall encloses the left portion 14L of the drive assembly 14.

Figure 4:
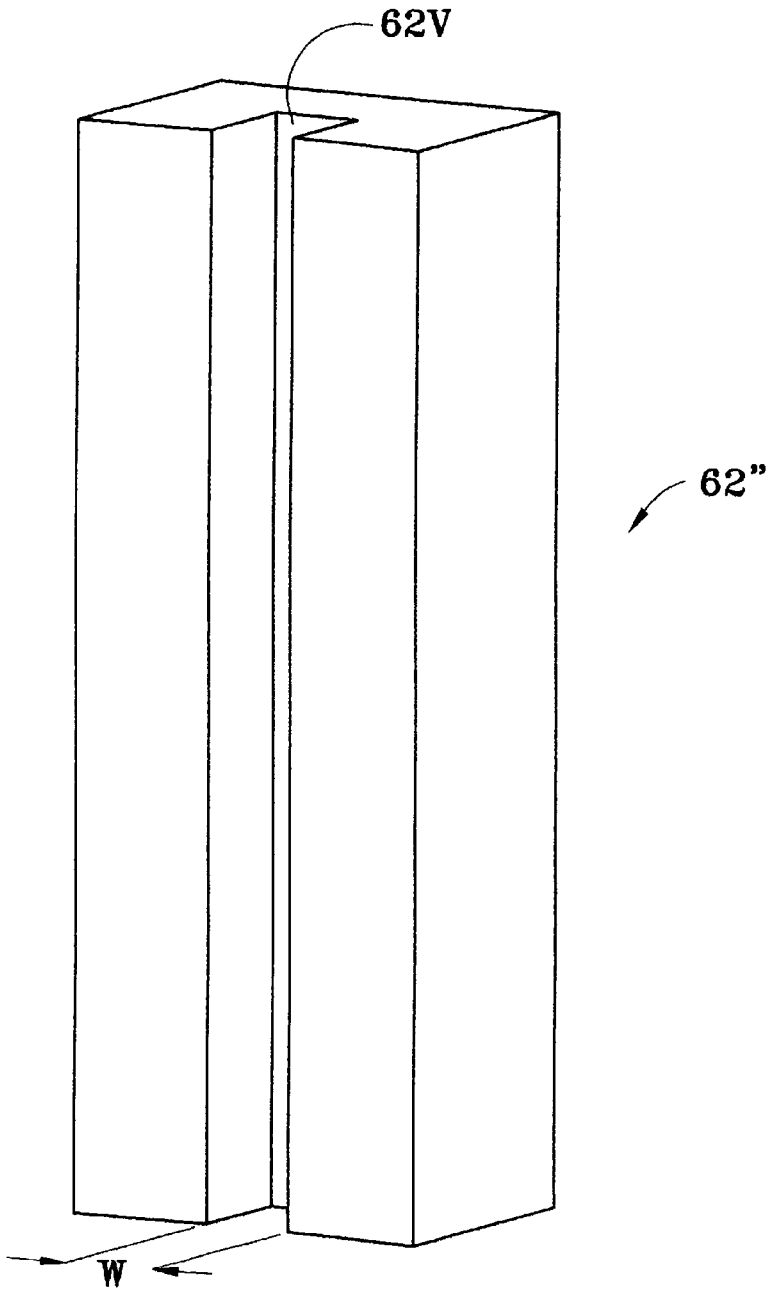
FIG. 4 is a perspective view of one channel guide, depicted separated from the drive assembly.
Figure 5:
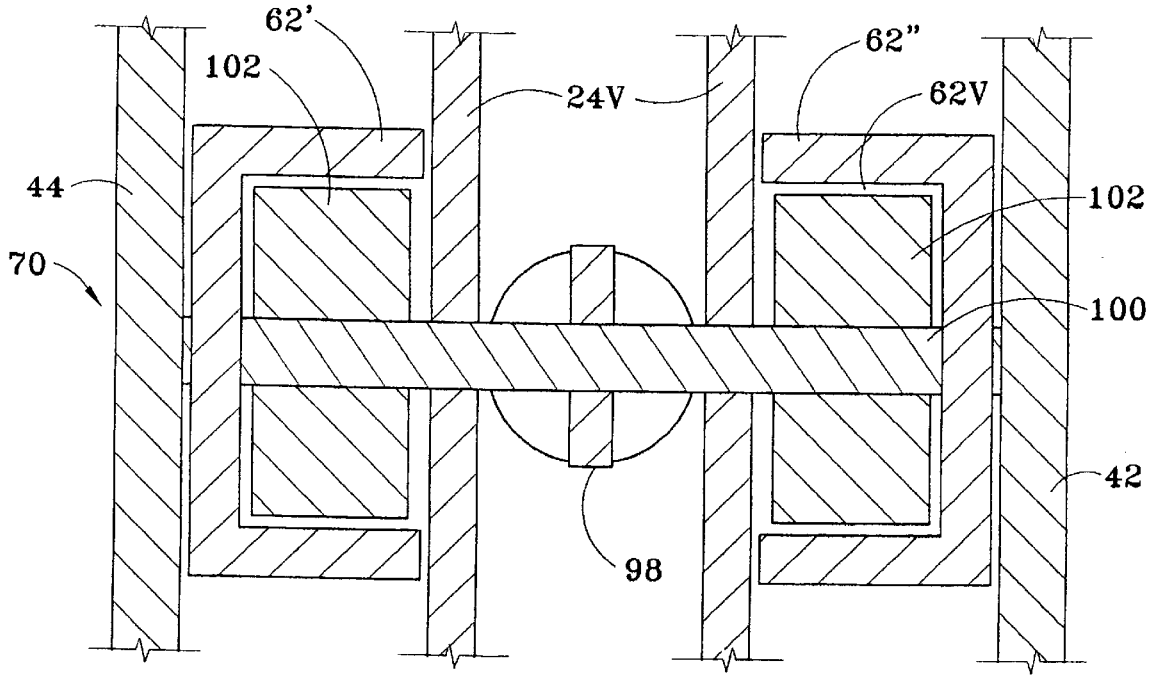
FIG. 5 is an enlarged, horizontal, cross-sectional view of a portion of the drive assembly taken along lines 5—5 of FIG. 3 and showing the movable lower rail pivot means disposed between the channel guides.
Figure 6:
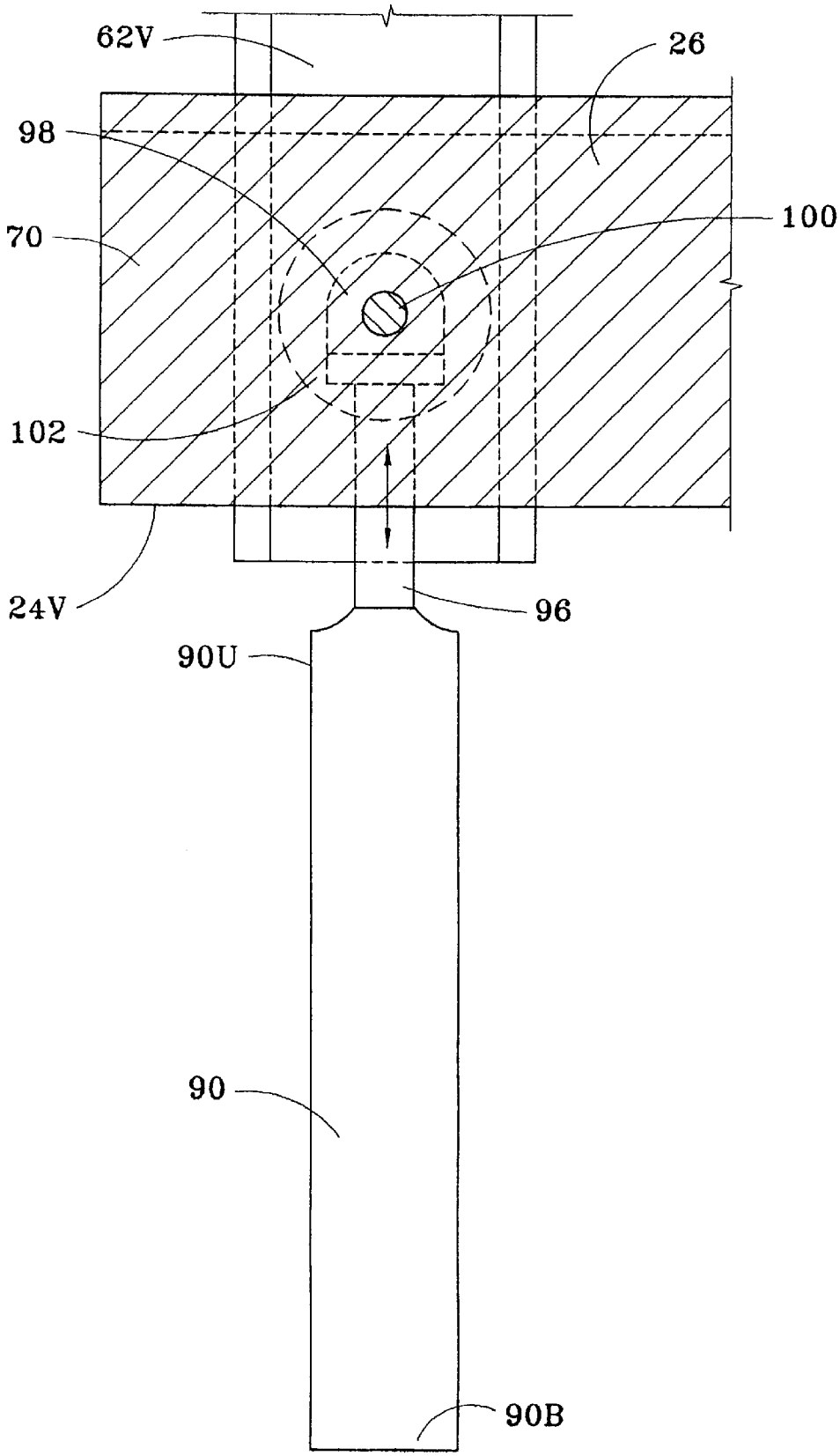
FIG. 6 is an enlarged rear elevational view of an upper portion of the hydraulic cylinder and of the movable lower rail pivot means.
Figure 10:
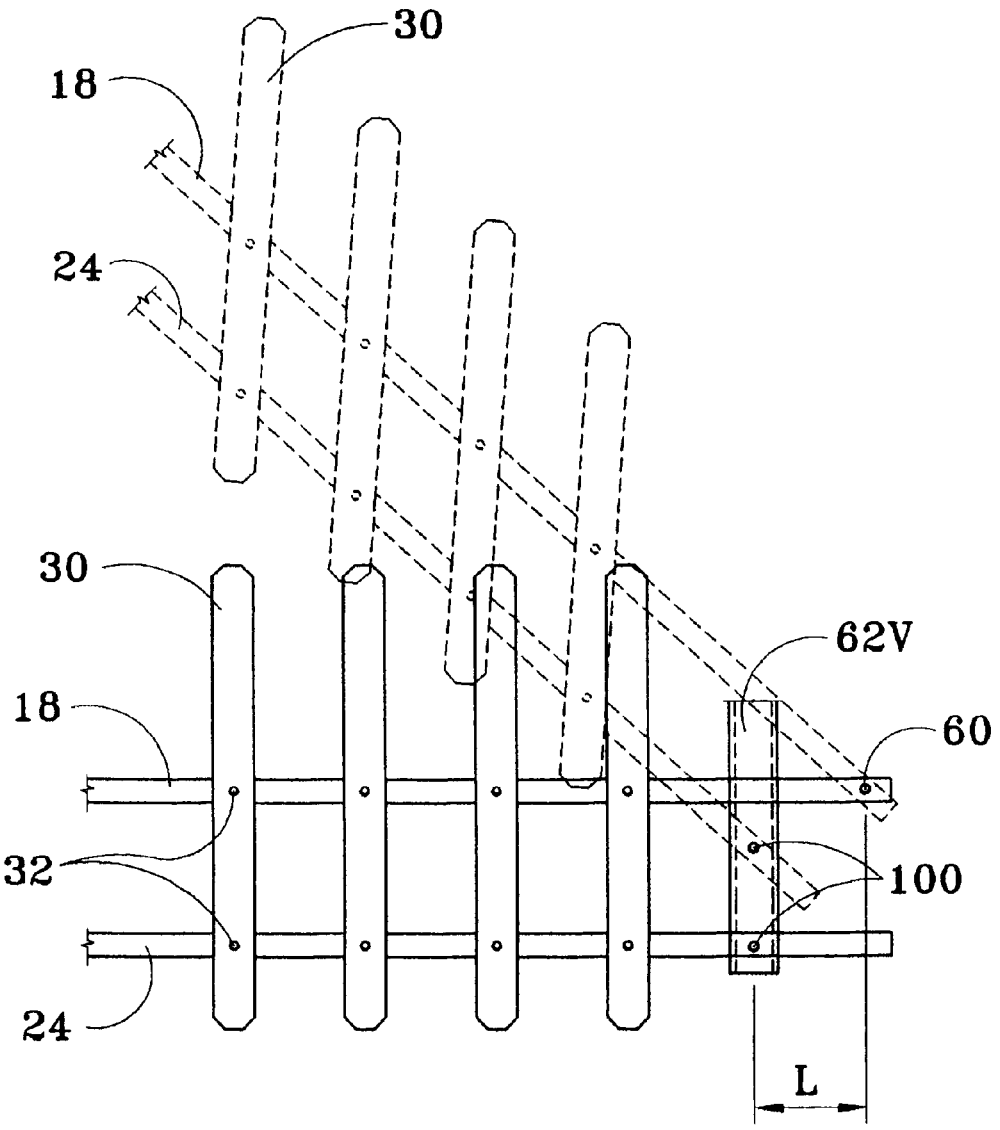
FIG. 10 is a schematic illustration of the arm assembly of the invention being raised from a first, lowered, horizontal position to a second, partially raised position (in phantom).

The drive assembly 14 further includes upper rail pivot means 60 attached to the first end 20 of the upper rail 18, which, in a preferred embodiment comprises an upper rail pivot pin 63 horizontally inserted through apertures (not shown) in the divider wall 44, said first end 20, and the right wall 42. One each of an identical pair of vertically-elongated, spaced-apart channel guides 62', 62" is attached to interior, apposed surfaces of the divider wall 44 and the right wall 42, as illustrated in FIGS. 3 and 5. The channel guides 62', 62" are longitudinally displaced a distance L with respect to the location of the upper rail pivot means 60 and a clevis pin 100, such that the pivotal attachment of the arm assembly 16 to the lift gate drive assembly 14 constitutes a third class lever, as may be seen in FIG. 10. As shown in FIGS. 4 and 5, each channel guide 62', 62" has a vertical groove 62V, said grooves being oppositely and symmetrically disposed with respect to one another. Movable lower rail pivot means 70, disposed within the channel guides 62', 62", is provided for moving the first, pivoted end 26 of the lower rail 24 between a first, lower position and a second, raised position, corresponding to reciprocating motion of the entire arm assembly 16 between the lowered position depicted in FIG. 1 and the raised position depicted in FIG. 2, respectively. The drive assembly 14 further includes a linear actuator means 80 attached to the housing 38 for actuating movements of the movable lower rail pivot means 70.

In a preferred embodiment, the linear actuator means includes a hydraulic drive system. A single rod, hydraulic cylinder 90 is disposed vertically between lower portions of the divider wall 44 and the right wall 42. A lower, blind end 90B of the cylinder 90 is attached to the housing 38. A cylinder rod 96 extends upwards from the cylinder 90, terminating in a traveling clevis 98. The movable lower rail pivot means 70 in this preferred embodiment includes the horizontal traveling clevis pin 100 inserted through the traveling clevis 98 and extending into each of the vertical grooves 62V, and a pair of rollers 102, one each of the rollers 102 being disposed within one of the grooves 62V and mounted for rotation about the pin 100. The diameter of the rollers 102 is substantially equal to the width W of the grooves 62V. The rollers 102 are made of UHVM®, an ultra high vacuum monomeric plastic rotatably mounted on UHVM® bushings, and lubricated with NYOIL®, an all purpose lubricating oil a product of Nye Lubricants, Inc., of Fairhaven, Mass. Preferably, the channel guides 62', 62" extend upward from the height of the upper, rod end 90U of the cylinder 90 on up to the height of the upper rail pivot means 60.

Figure 7:
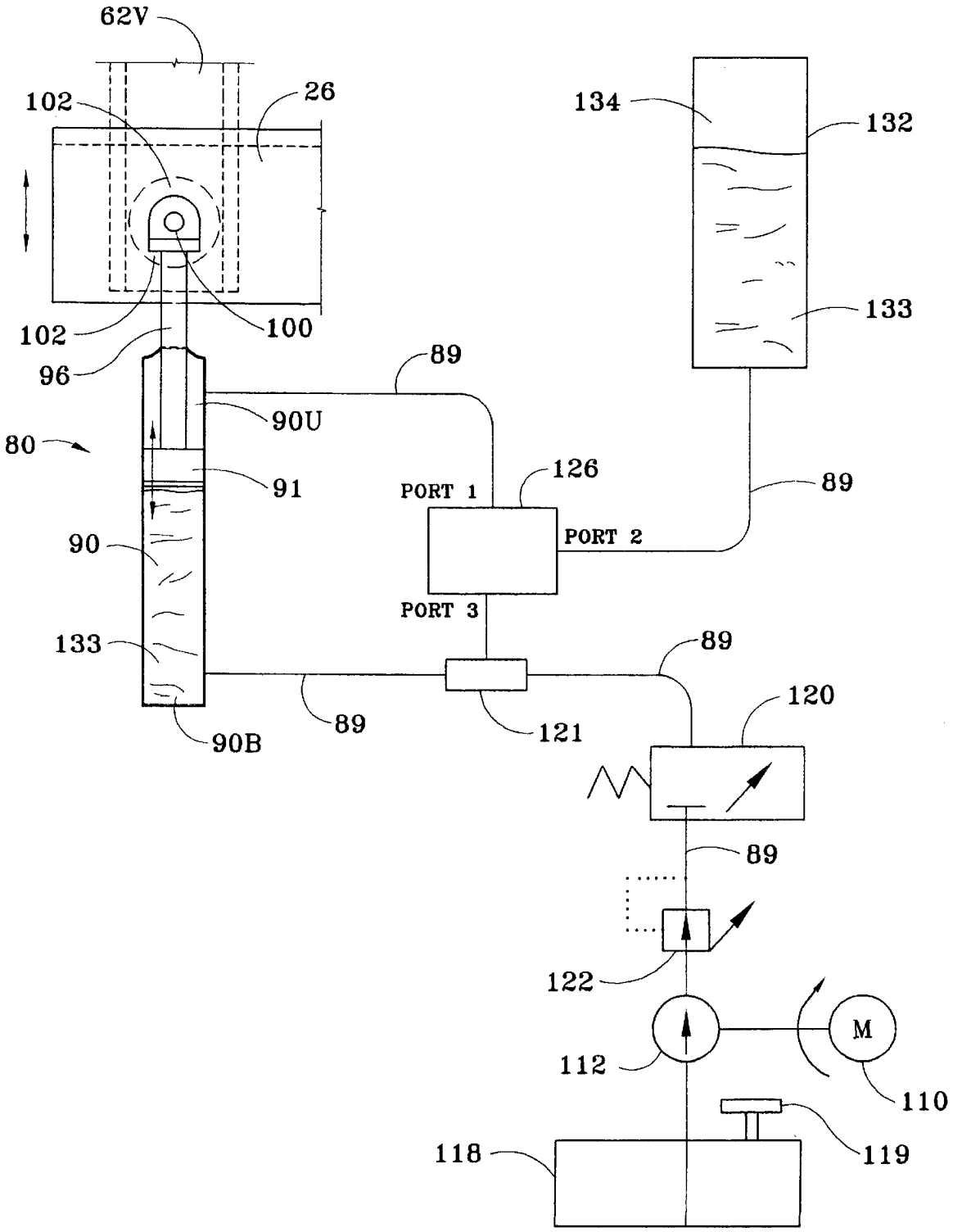
FIG. 7 is a hydraulic fluid power circuit for the invention.

The hydraulic drive system further comprises the combination of an electric motor 110 in driving engagement with a hydraulic pump 112, mounted on a shelf 56. Referring now to FIG. 7, it may be seen that the pump 112 is equipped with a closed hydraulic reservoir 118 that communicates with the pump 112 through conduit 89. The pump 112 is also equipped with a flow control valve 122, as well as a breather cap 119 for the reservoir 118. A suitable such motor and pump combination is available from John S. Barnes Corporation of Rockford, Ill., which is also equipped with a flow control valve 122. When the arm assembly 16 is to be raised, hydraulic fluid 133 pumped under pressure from the pump 112 is conducted through a solenoid-actuated return valve 120 to a first port of a T connector 121. Hydraulic fluid 133 is conducted from a second port of the T connector to the blind end 90B of the hydraulic cylinder 90. Hydraulic fluid 133 is conducted from the upper, rod end 90U of the cylinder 90 to port number 1 of a three way, two position, pressure-sensitive, hydraulic valve 126. The three ways of valve 126 are "closed," "open," and "bypass." When the arm assembly 16 is being raised, hydraulic pressure generated by the energized pump 112 is communicated through the T connector to port number 3 of the valve 126, which causes pressure-sensitive valve 126 to open. When the valve 126 is open, and only when the valve 126 is open, hydraulic fluid 133 is permitted to flow from the valve 126 through port number 2 to an accumulator 132, but only until the arm assembly 16 reaches a substantially vertical position—at which point a normally closed limit switch 255 opens when contacted by the pivot end of the uper rail 18, thereby de-energizing the motor 110 and stopping the hydraulic pump 112. As the amount of hydraulic fluid 133 in the accumulator 132 increases, air 134 within the accumulator 132 becomes compressed and air pressure rises, thereby creating a back pressure that tends to force the fluid 133 back out of the accumulator 132. When the raised arm assembly 16 is to be lowered, return valve 120 is opened and valve 126 is placed at "bypass"—i.e., ports number 2 and 1 are both open and in communication—whereupon the arm assembly 16 and the piston 91 in the cylinder 90 descend, thereby draining fluid from the cylinder 90 back to the reservoir 118; meanwhile, valve 126 permits fluid to flow from the accumulator 132 into port number 2 of valve 126, through port number 3 of valve 126, and back through the T connector 121 to the reservoir 118. When the arm assembly is fully lowered, the return valve 120 again closes, thereby preventing manual opening of the gate.

Figure 8:
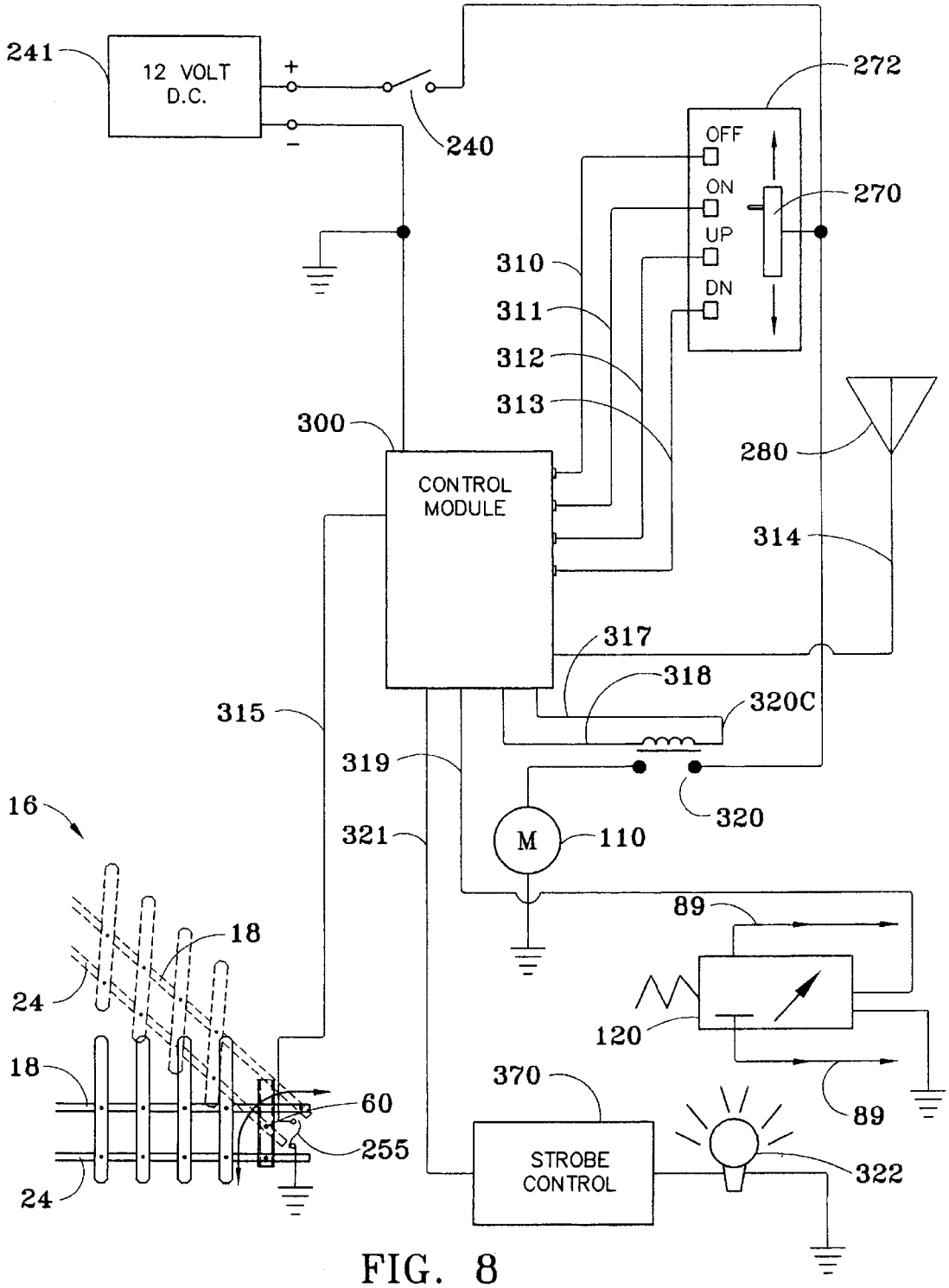
FIG. 8 is a schematic diagram for the lift gate control system.

The invention includes an electronic control system, depicted schematically in FIG. 8, for controlling the raising and lowering of the arm assembly 16 in response to manual signals and/or in response to RF signals initiated by RF sending units activated from within vehicles approaching the lift gate 10. An electronic control module 300 suitable for this purpose is the Model 6961K available through Liftmaster Electronics Pty., Ltd., of Mascot, Australia. An electric power switch 240 is wired in series with the negative terminal of a 12 volt d.c. power source 241 and with the sliding contact 270 of a four position, manual switch 272. The switch 272 has a first contact, labeled "OFF;" a second contact, labeled "ON;" a third contact, labeled "UP;" and a fourth contact, labeled "DN, and these contacts are wired to the control module by lines 310, 311, 312, and 313, respectively. An antenna 280 for receiving RF control signals from RF sender units (not shown) inputs the signals to the control module 300 by line 314. A normally closed, upper limit switch 255, wired to the electronic control module 300 by input line 315, is mounted to the housing 38, adjacent the pivot end of the upper rail 18 such that it will be contacted and opened by the arm assembly 16 when the arm assembly 16 is raised to substantially vertical. Once the power switch 240 has been closed, movement of the sliding contact 270 from the "OFF" contact to the "UP" contact causes the control module 300 to energize the solenoid coil 320C of solenoid switch 320 via output lines 317, 318, thereby closing the switch 320 and energizing the motor 110. The control module 300, through output line 319, also energizes the normally closed, solenoid-actuated, return valve 120, causing it to open, thereby permitting hydraulic fluid 133 to flow from the pump 112 to the T connector 121. At the same time, the control module 300 signals a strobe control unit 370, via output line 321, to cause strobe light 322 to flash a warning signal. When the arm assembly has risen to substantially vertical, the upper limit switch 255 opens, whereupon the control module, via ouput lines 317, 318, de-energizes the solenoid 320C, causing switch 320 to open and the motor 110 and pump 112 to shut down. With the pump 112 shut down, the reduced hydraulic pressure causes valve 126 to close. When the sliding contact 270 is moved to the "DN" contact, return valve 120 is opened via a signal from output line 319, and hydraulic fluid drains from the cylinder blind end 90B back to the reservoir 118 while the arm assembly 16 lowers. When an RF sending control unit is used to control the arm assembly 16 instead of the manual control switch 272, the same control functions are implemented by the control module 300 based upon decoded RF signals, in a manner well known to those of ordinary skill in the art.

It will be appreciated that various modifications can be made to the exact form of the present invention without departing from the scope thereof. It is accordingly intended that the disclosure be taken as illustrative only and not limiting in scope, and that the scope of the invention be defined by the following claims.

We claim:

1. A parallelogram gate for controlling traffic along a roadway, comprising:

(a) an arm assembly movable between a horizonal, roadway-blocking position and a raised position, said assembly including:

(1) an elongated, upper rail having a first pivoted end and an opposite free end;

(2) an elongated, lower rail parallel to the upper rail, having a first, pivoted and an opposite free end; and (b) a drive assembly for placement on a first side of the roadway, including:

(1) a housing;

(2) stationary upper rail pivot means disposed within, and attached to, the housing, for pivotally attaching the first end of the upper rail to the housing;

(3) a pair of vertically-elongated, laterally spaced-apart channel guides attached to the housing at a location within the housing that is intermediate a lower end of the housing and the upper rail pivot means, each said channel guide having an elongated vertical groove, said grooves being oppositely and symmetrically disposed with respect to one another;

(4) movable lower rail pivot means pivotally attached to the first end of the lower rail and disposed within said channel guides for movement within the vertical grooves thereof between a first, lower position and a second, upper position; and (5) linear actuator means attached to the housing for moving the lower rail pivot means within said channel guides.

2. The gate of claim 1, wherein the linear actuator means includes a hydraulic drive system, comprising:

(a) a hydraulic cylinder having a lower end attached to the housing, and a cylinder piston arm pivotally attached to the first end of the lower rail;

(b) an electric motor mounted to the housing;

(c) a hydraulic pump in driving engagement with said electric motor and equipped with a flow control valve for controlling release of hydraulic fluid from the pump;

(d) a hydraulic reservoir for storing the hydraulic fluid and in fluid communication with the pump;

(e) a three-way, two-position, pressure-sensitive, hydraulic valve having a first port, a second port, and a third port, and three states of operation comprising valve closed, valve open, and valve bypass, the third port thereof being connected by hydraulic conduit to an upper end of the hydraulic cylinder;

(f) a T connector having a first port connected by conduit to the hydraulic pump, a second port connected by hydraulic conduit to a blind end of the hydraulic cylinder, and a third port connected by hydraulic conduit to the third port of the three-way, two-position, pressure sensitive, hydraulic valve; and (g) a hydraulic accumulator connected by hydraulic conduit to the second port of the three-way, two-position, pressure sensitive, hydraulic valve.

3. The parallelogram gate of claim 1, wherein the channel guides are C-shaped in horizontal cross-section, the linear actuator means comprising a hydraulic cylinder and a piston arm disposed within the hydraulic cylinder, said piston arm carries a traveling clevis having a horizontal bore, and the lower rail pivot means includes:

(a) a clevis pin inserted through the bore of the traveling clevis and extending into each of the vertical grooves; and (b) a pair of laterally spaced-apart rollers, each one of the rollers being disposed within a respective one of the grooves and mounted for rotation about the clevis pin.

4. The parallelogram gate of claim 3, further comprising a vertical barrier post for placement on a second side of the roadway opposite to said first side of the roadway, said post having a C-shaped horizontal cross-section that defines a vertically-elongated recess that receives the free ends of the upper and lower rails when the arm assembly is in the horizontal, roadway-blocking position.

5. The parallelogram gate of claim 4 further comprising a plurality of pickets distributed along the lengths of the rails, each picket being pivotally attached to the upper and lower rails.

* * * * *